US006913370B2

(12) United States Patent
Ping

(10) Patent No.: US 6,913,370 B2
(45) Date of Patent: Jul. 5, 2005

(54) FLASHLIGHT

(75) Inventor: Qiu Jian Ping, Hangzhou (CN)

(73) Assignee: Great Neck Saw Manufacturers, Inc., Mineola, NY (US)

( * ) Notice: Subject to any disclaimer, the term of this patent is extended or adjusted under 35 U.S.C. 154(b) by 12 days.

(21) Appl. No.: 10/677,506

(22) Filed: Oct. 2, 2003

(65) Prior Publication Data

US 2005/0073837 A1 Apr. 7, 2005

(51) Int. Cl.[7] ..... F21L 4/00
(52) U.S. Cl. ..... 362/199; 362/197; 362/427
(58) Field of Search ..... 362/197, 199, 362/427

(56) References Cited

U.S. PATENT DOCUMENTS

| | | | | |
|---|---|---|---|---|
| 699,546 | A | | 5/1902 | Merritt |
| 1,689,382 | A | | 10/1928 | Eaton |
| 1,699,927 | A | | 1/1929 | Stearns |
| 1,807,129 | A | | 5/1931 | Nuckolls |
| 1,863,151 | A | | 6/1932 | Barber |
| 1,899,868 | A | | 2/1933 | Herlbauer |
| 2,040,423 | A | | 5/1936 | Barber |
| D113,400 | S | | 2/1939 | Ritter |
| 2,205,163 | A | | 6/1940 | Blau |
| 2,401,366 | A | | 6/1946 | Muldoon |
| 2,539,974 | A | | 1/1951 | Riddell |
| 2,796,516 | A | | 6/1957 | Martschik |
| 4,196,821 | A | | 4/1980 | Teti, Jr. |
| 4,432,042 | A | | 2/1984 | Zeller |
| 4,447,863 | A | | 5/1984 | Fenne |
| 4,464,707 | A | | 8/1984 | Forrest |
| 4,466,664 | A | | 8/1984 | Kondou |
| 4,495,550 | A | | 1/1985 | Visciano |
| 4,533,982 | A | | 8/1985 | Kozar |
| 4,586,113 | A | | 4/1986 | Tsuyama |
| 4,706,331 | A | | 11/1987 | Compton |
| 4,739,457 | A | | 4/1988 | Orr |
| 4,782,435 | A | | 11/1988 | Manzoni |
| 4,937,713 | A | | 6/1990 | Holt et al. |
| 4,949,928 | A | | 8/1990 | Hoshino |
| 4,974,130 | A | | 11/1990 | Friedman |
| 5,119,280 | A | | 6/1992 | Yang |
| 5,239,451 | A | * | 8/1993 | Menke et al. ..... 362/199 |
| 5,355,746 | A | | 10/1994 | Lin |

(Continued)

FOREIGN PATENT DOCUMENTS

| | | |
|---|---|---|
| DE | 327882 | 10/1920 |
| DE | 522078 | 3/1931 |

*Primary Examiner*—Stephen F Husar
(74) *Attorney, Agent, or Firm*—Joseph J. Previto

(57) ABSTRACT

A flashlight having a handle and a head pivotally mounted on the handle, a bulb within the head, and a battery within the head. An electrical circuit between a battery and the bulb so that the bulb can be turned on and off. The handle has a pair of spaced upstanding ears and the head has opposed sides and is pivotally mounted between the upstanding ears. Openings in the ears and in the opposed sides of the head to receive pivots so that the head can pivot relative to the upstanding ears and the handle. The circuitry includes electrical head contacts on the head and electrical ear contacts on the ears in electrical circuit with each other. The electrical ear contacts and the head electrical contacts means being adjacent to the openings in the ears and the head.

12 Claims, 6 Drawing Sheets

U.S. PATENT DOCUMENTS

| | | | |
|---|---|---|---|
| 5,410,457 | A | 4/1995 | Parker |
| 5,541,822 | A | 7/1996 | Bamber |
| 5,988,828 | A | 11/1999 | Prince et al. |
| 5,993,022 | A | 11/1999 | Neyer et al. |
| 6,012,824 | A | 1/2000 | Sharrah et al. |
| D445,925 | S | 7/2001 | Parker |
| 6,457,841 | B1 | 10/2002 | Lynch et al. |
| D468,850 | S | 1/2003 | Sharrah et al. |
| D476,437 | S | 6/2003 | Dalton et al. |
| D477,102 | S | 7/2003 | Yuen |

* cited by examiner

FLASHLIGHT

BACKGROUND

The present invention relates to flashlights and more particularly to flashlights having a head that swivels relative to the handle.

Such swivel flashlights have been well known in the industry for a number of years. However, some of these flashlights have complicated mechanisms for moving the head from side to side and for holding the head in a predetermined position. Other of such swivel flashlights have complicated mechanisms for electrically connecting the battery to the bulb. Still others are expensive to manufacture and assemble.

Objects

The present invention overcomes these difficulties and has for one its objects the provision of an improved flashlight that has a head which swivels relative to the handle.

Another object of the present invention is the provision of an improved flashlight that has improved means for holding the swivel head in a predetermined position.

Another object of the present invention is an improved flashlight which has simple circuitry to connect the battery to the bulb.

Another object of the present invention is the provision of an improved flashlight which is inexpensive to manufacture and assemble.

Another object of the present invention is the provision of an improved flashlight which is simple to use.

Other and further objects of the invention will be obvious upon an understanding of the illustrative embodiment about to described, or will be indicated in the appended claims and various advantages not referred to herein will occur to one skilled in the art upon employment of the invention in practice.

DRAWINGS

A preferred embodiment of the invention has been chosen for purposes of illustration and description and is shown in the accompanying drawings forming a part of the specification, wherein.

DESCRIPTION

Figure 1:
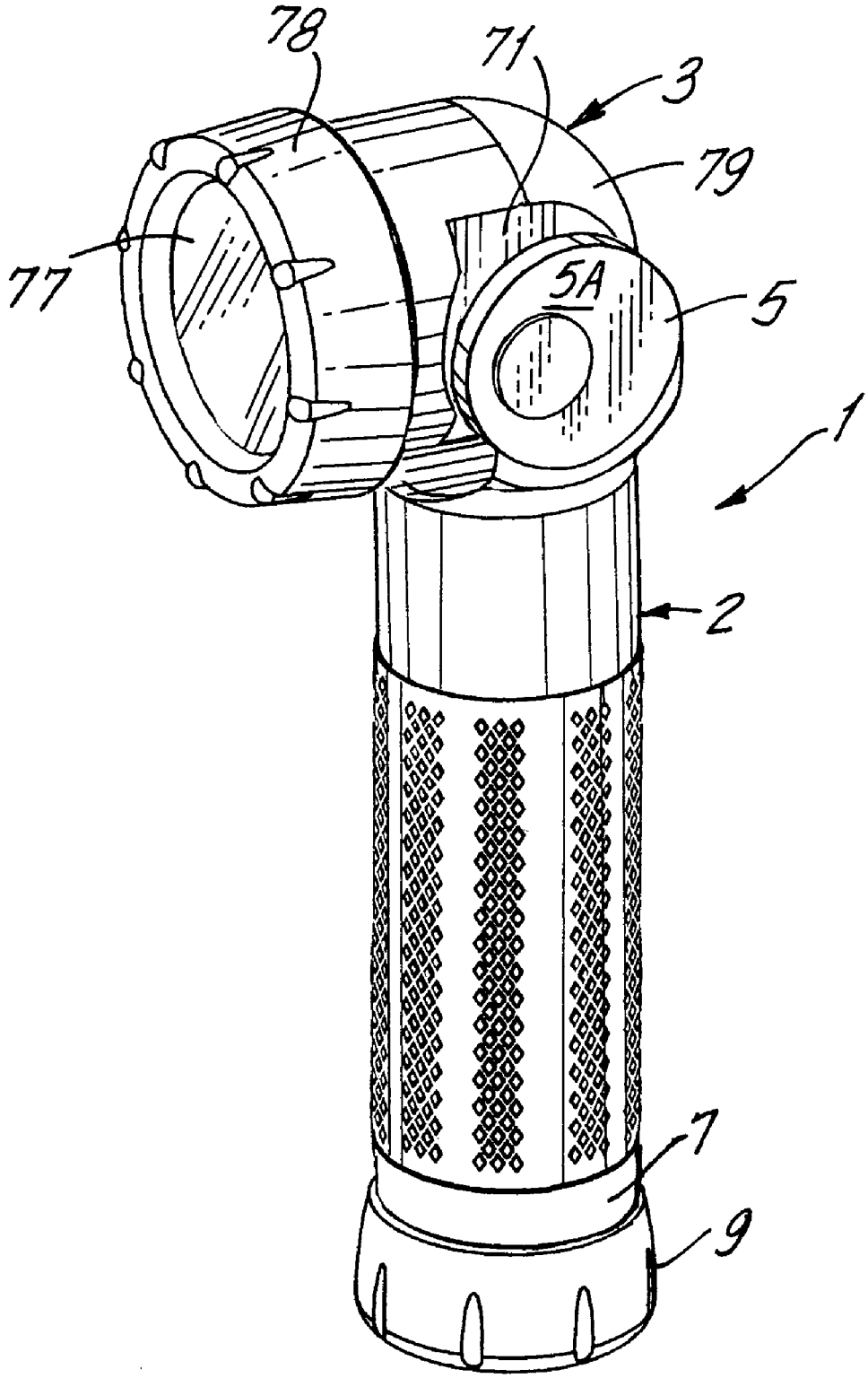
FIG. 1 is a perspective view showing the flashlight of the present invention.
Figure 2:
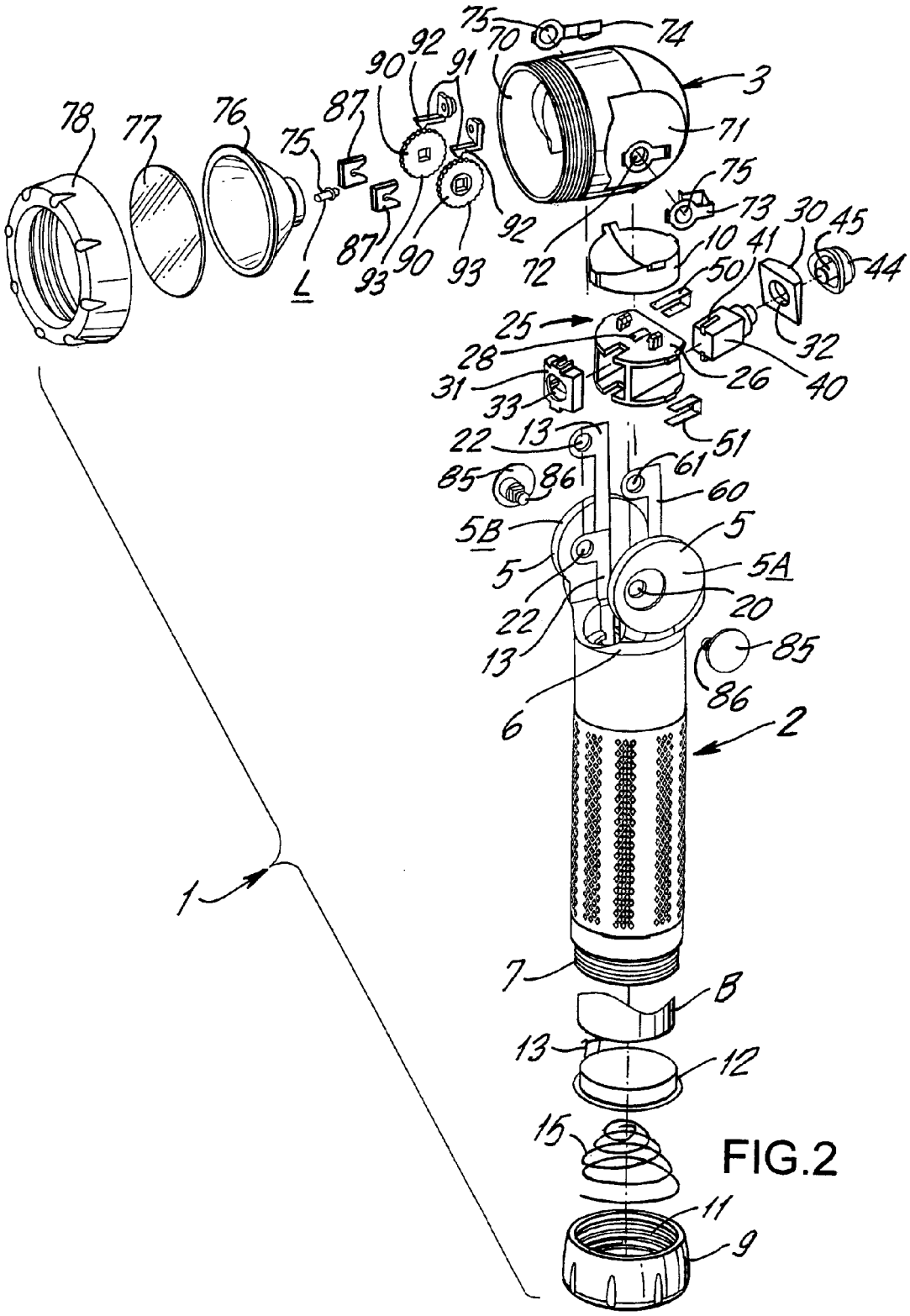
FIG. 2 is an exploded view of the flashlight of the present invention.
Figure 3:
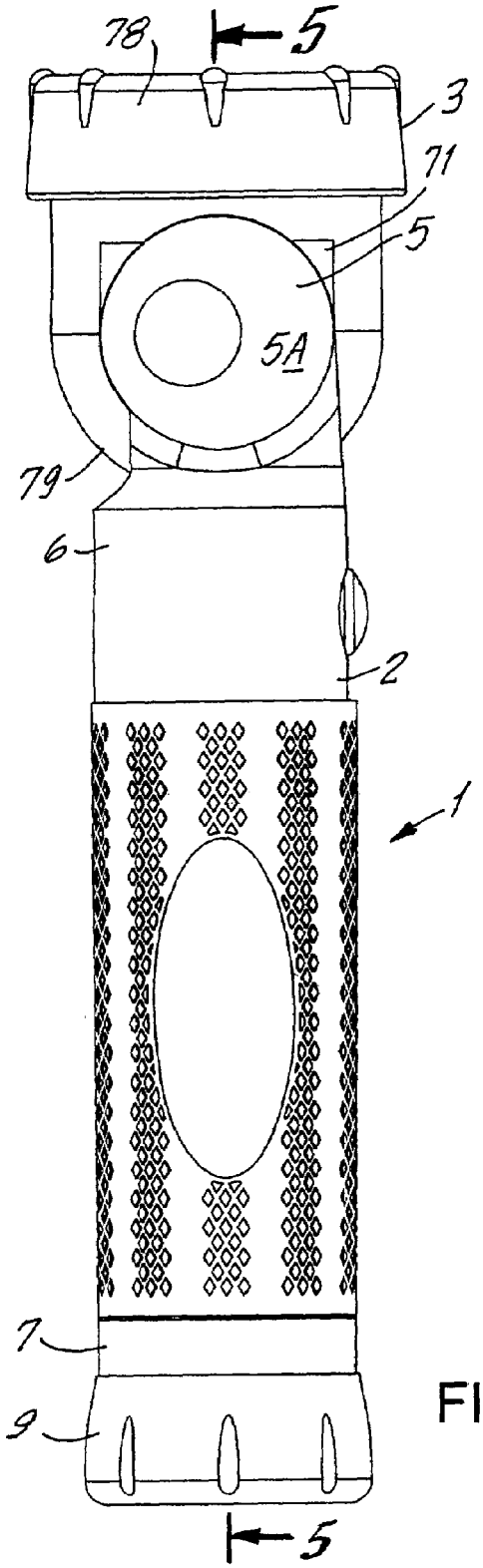
FIG. 3 is a side view of the flashlight showing one position of the head.
Figure 4:
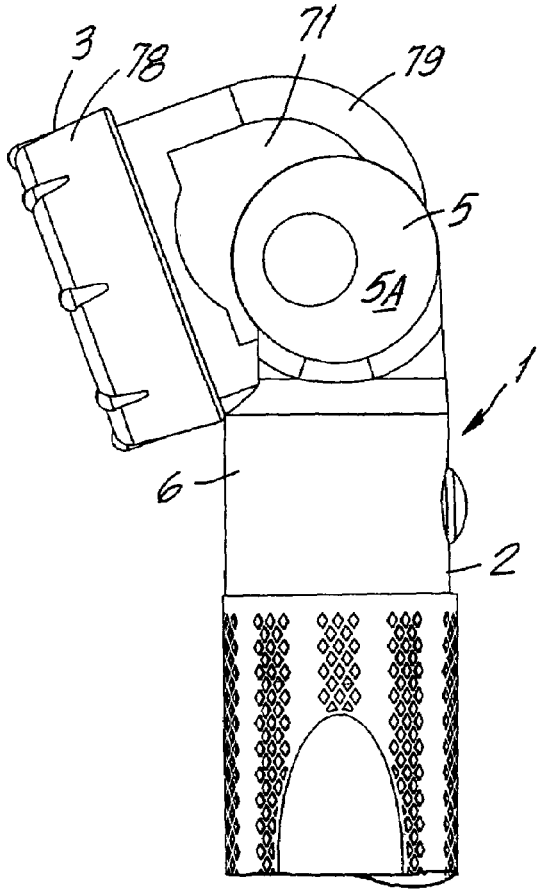
FIG. 4 is a side view similar to FIG. 3 showing another position of the head.
Figure 5:
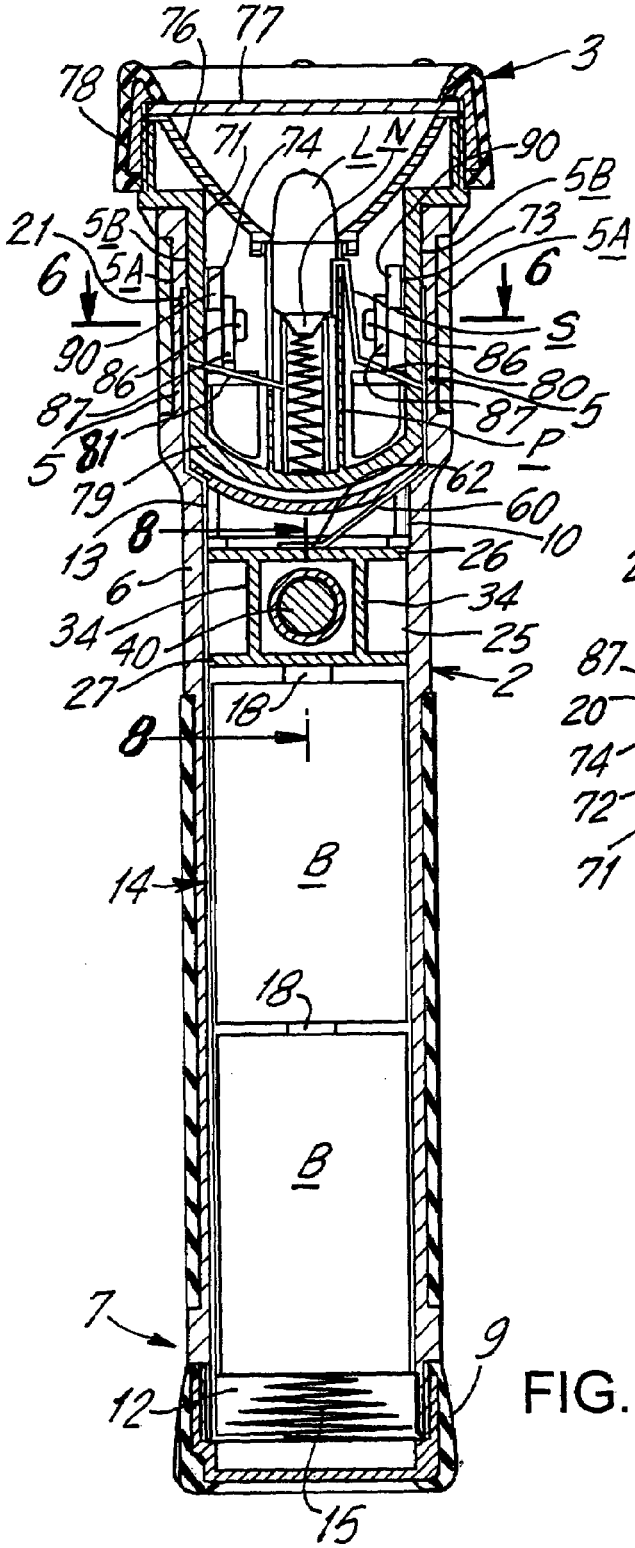
FIG. 5 is a sectional view taken along line 5—5 of FIG. 3.
Figure 6:
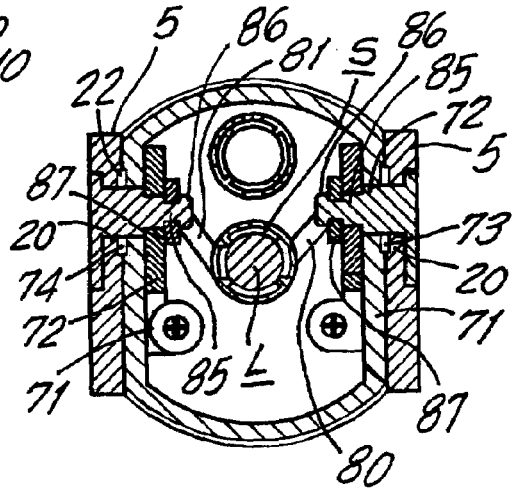
FIG. 6 is a sectional view taken along line 6—6 of FIG. 5.
Figure 7:
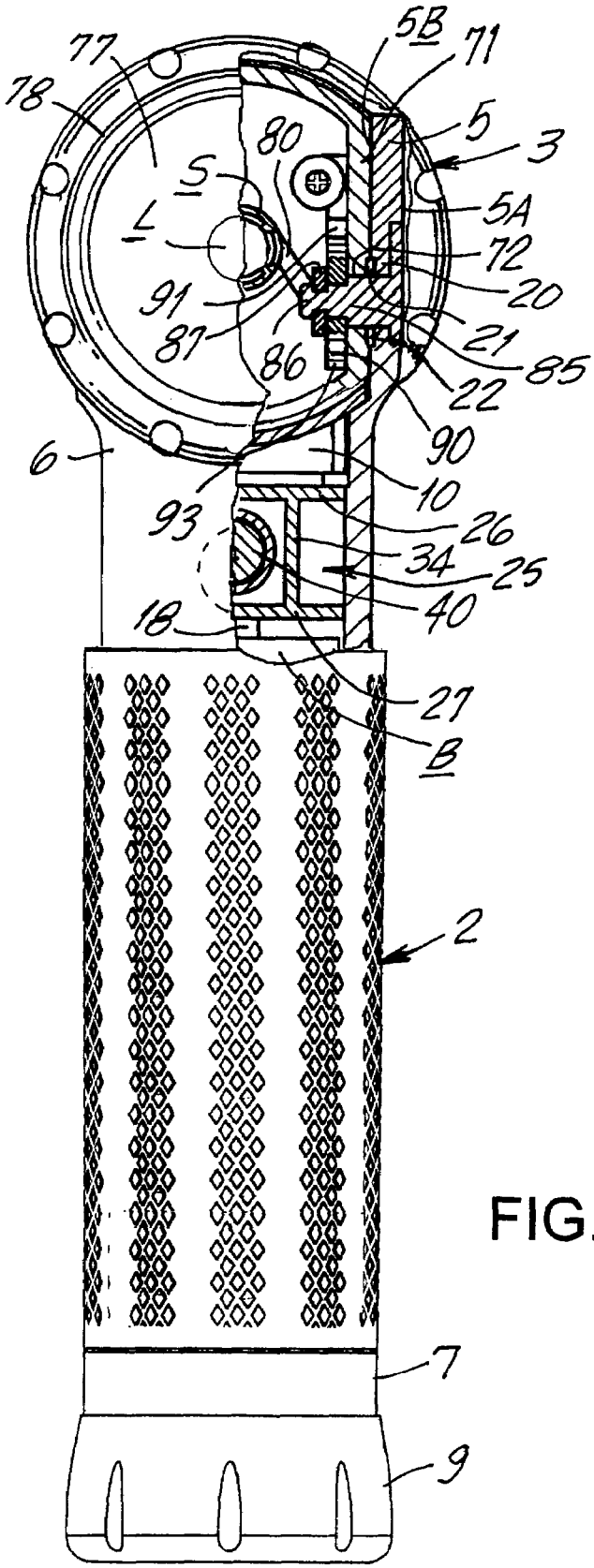
FIG. 7 is a front view of the flashlight, partly in section.
Figure 8:
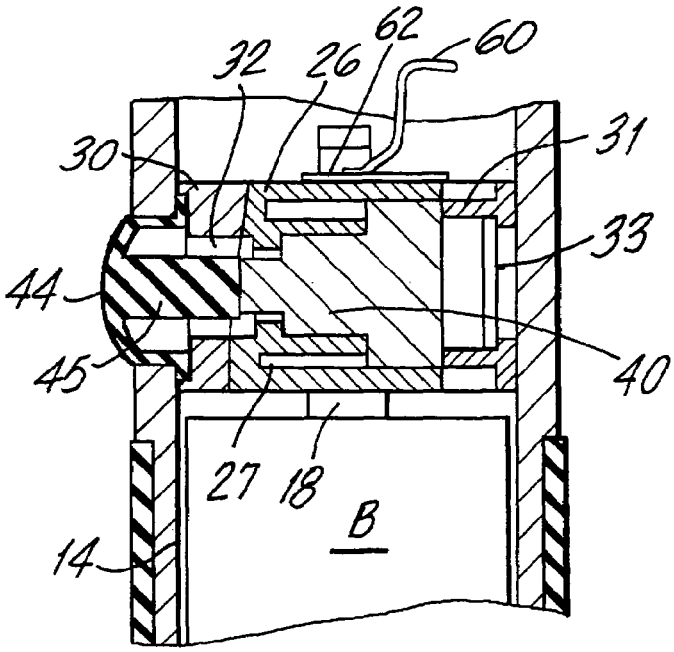
FIG. 8 is a sectional view taken along line 8—8 of FIG. 5.

Referring to the drawings, the flashlight 1 of the present invention comprises a handle 2 and a head 3 pivotally mounted on the handle 1 in a manner which will be described in greater detail hereinbelow.

The handle 2 is hollow and elongated and has an upper end 6 with a pair of spaced upstanding ears 5 and a threaded lower end 7 on which an cap 9 is threadably and removably mounted by means of interior threads 11 on the end cap 9. Preferably the handle is made of a plastic material but other materials may also be used, as may be desired. In addition, the upstanding ears 5 are integral with the handle 2 and preferably each ear has opposed flat surfaces 5A and 5B. An upper cap 10 is provided to close the upper end 6 of the hollow handle 2.

A electrical contact sleeve 12 is mounted within the lower end 7 of the handle 2 and has a negative elongated contact 13 extending upwardly therefrom along an interior wall 14 of the handle 12 for the full length of the handle 2 and beyond its upper end 6. The negative elongated contact 13 passes beyond the upper cap 10 between the upper cap 10 and the interior wall 14 and lies adjacent an ear 5. A spring 15 is mounted within the contact sleeve 12. Batteries B are mounted within the handle 2 and rest on the spring 15 which pushes the batteries B upwardly. In the drawings, a pair of batteries B have been shown, however, the flashlight may be shortened so that a single battery B can be used, if desired. The spring 15 is in contact with the negative side 17 of the batteries B. The positive side 18 of the batteries B is in contact with a switch assembly 25. A preferred switch assembly 25 is shown, but others may be used if desired. Each of the opposed ears 5 has an opening 20 therein and the upper end 21 of the negative elongated contact 13 has an opening 22 at the upper end which is in alignment with the ear opening 20.

Figure 9:
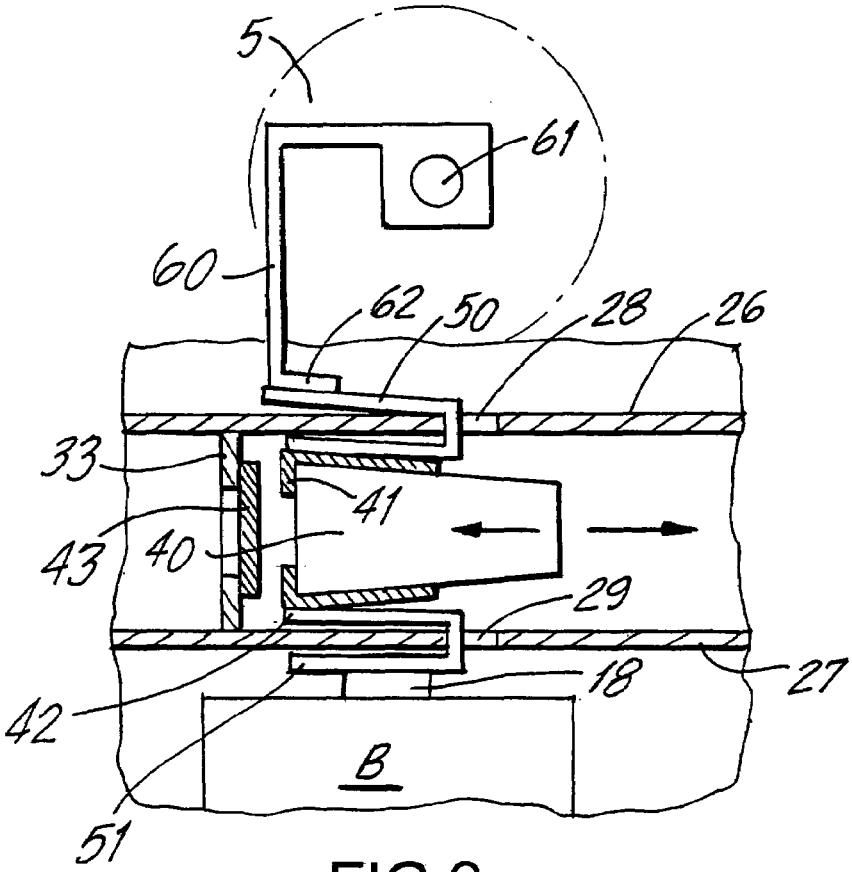
FIG. 9 is a simplified schematic view of the control switch used to switch the flashlight on and off.

The switch assembly 25 is provided adjacent the upper end 6 of the hollow handle 2 between the upper cap 10 and the batteries B. The switch assembly 25 comprises upper and lower walls 26 and 27, respectively, with upper and lower openings 28 and 29 therein. It is also provided with front and rear walls 30 and 31 having openings 32 and 33 therein, respectfully, and side walls 34. The rear wall 34 is provided with a vertical wall contact 43 (FIG. 9). A movable contact carrier 40 is provided with upper and lower carrier contacts 41 and 42, respectively, and is movable between the walls 26, 27 and 34 of the switch assembly 25. The carrier contacts 41 and 42 are in line with the wall contact 43 so as to strike it when the contact carrier is moved in. A push button 44 is provided with a plunger 45 which strikes the contact carrier 40 to move the contact carrier 40 back and forth in order to move the carrier contacts 41—41 into and out of circuit with wall contact 43. The upper and lower walls 26–27 of the switch assembly 25 have u-shaped upper and lower spring contacts 50 and 51, respectfully, extending through the openings 28–29, respectively, in the upper and lower walls 26–27, respectively. Preferably they are u-shaped and straddle the upper and lower walls 26–27 of the switch assembly 25. The lower u-shaped spring contact 51 is in contact with the positive terminal 18 of the battery B. The upper u-shaped spring contact 51 is in circuit with the positive side of the flashlight bulb L as will be described in greater detail hereinbelow. When the push button 44 is moved inwardly, the contact carrier 40 is moved forward so that the contacts 41 and 42 strike the upper and lower u-shaped spring contacts 50 and 51, respectively, as well as the wall contact 43 to close a circuit between the battery and the upper u-shaped contact 50. When the push button 44 is pushed again the contact carrier 40 is moved back so that the carrier contacts 41 and 42 are moved-out of contact with the u-shaped spring contacts 50 and 51 and out of contact with the wall contact 43.

A positive elongated contact 60 (shorter than the negative elongated contact 13) extends from the handle interior and lies adjacent the other ear 5 of the handle 2. This positive elongated contact 61 has an opening 60 which is in alignment with the opening 20 in the other ear 5 and has a foot 62 at its lower end which sits on and is in contact with the upper u-shaped spring contact 50. When the push button 44 is pushed in, the batteries B will be circuit with the positive elongated contact 60 through foot 62, upper u-shaped spring contact 50, the wall contact 43, the carrier contacts 41 and 42 and the lower u-shaped spring contact 51.

The head 3 of the flashlight 1 comprises a substantially hollow interior 70 with opposed flat sides 71 that fit between the ears 5 of the handle 2 and a bowl shaped rear end 79. The flat sides 71 each have an openings 72 therein into which are positioned u-shaped positive and negative connecting contacts 73 and 74, respectively, each of which also have an opening 75 therein in alignment with openings 72 in flat sides 71. When the head 3 is placed between the ears 5, the u-shaped position and negative connecting contacts 73 and 74 are in contact with the two positive and negative elongated contacts 60 and 13, respectively. The bulb L is mounted in a bulb socket S at the center of head 3. A reflector 76, a front transparent cover 77 and a cover cap 78 threadably mounted onto the head 3 are also provided.

The bulb holder S has a positive side P from which a flat wire 80 extends which is in circuit with the battery positive 18 through the intermediation of u-shaped positive connecting contact 73, the positive elongated contact 60, the foot 62, upper and lower u-shaped spring contacts 50 and 51 will contact 43 and carrier contacts 41–42. The negative side N of the bulb L has a flat wire 81 in circuit with the battery negative side 17, the u-shaped negative connecting contact 74, the negative elongated contact 13 and the contact sleeve 12. The circuit is closed by moving the push button 44 inwardly and the circuit is opened by moving the push 44 button outwardly.

The openings 20 in the ears 5 of the handle and the openings 72 in the flat sides 71 of the head 3 are in alignment with each other and are held together by pivot pins 85 which extends through the openings 70–72 and openings 75 in the u-shaped positive and negative connecting 73–74 and into the interior of the head 3. The pivot pins 85 have enlarged inner ends 86 and are locked in place by nuts 87 attached to the pivot pins 85 within the end 86.

In order to hold the head 3 in a particular angled position, ratchet wheels 90 having teeth 93 are mounted on the pivot pin ends 86 and pawls 91 are mounted at the rear (not shown) of the head 3. The pawls 91 have teeth 92 which mesh with the ratchet wheel teeth 93. When the head 3 is swivelled, the ratchet wheels 90 are rotated along the head 3 relative to the pawls 91 until a particular position is reached and the pawl teeth 92 dig into the ratchet wheel teeth 93 to hold the head 3 in a particular position.

It will thus be seen that the present invention provides an improved flashlight that has a head which swivels relative to the handle, that has improved means for holding the swivel head in a predetermined position, which has simple circuitry to connect the battery to the bulb, which is inexpensive to manufacture and assemble and which is simple to use.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A flashlight comprising a handle and a head pivotally mounted on said handle, means for mounting a bulb within the head, said handle adapted to receive a battery, circuit means to adapt to create an electrical circuit between a battery in said handle and a bulb whereby the bulb can be turned on and off, said handle having a pair of spaced upstanding ears, said head having opposed sides and being pivotally mounted between said upstanding ears, openings in said ears and in said opposed sides of said head, pivot means mounted in said openings in said head and said ears whereby said head can pivot relative to said upstanding ears and to said handle, said circuit means including electrical head contact means on said head and electrical ear contact means on said ears, said head electrical contact means and said ear electrical contact means being in electrical circuit with each other, said ear electrical contact means and said head electrical contact means being adjacent to the openings in said ears and said head respectively, said head electrical contact means comprise connecting head contacts mounted at the openings in said head, said ear electrical contact means comprise elongated ear contacts mounted at said ears, said connecting head contacts comprise a positive connecting contact in circuit with the positive side of a bulb and a negative connecting contact in circuit with the negative side of a bulb and wherein said elongated ear contacts comprise a positive elongated ear contact in circuit with the positive terminal of a battery and a negative elongated ear contact in circuit with the negative terminal of a battery, a switch assembly is mounted within the handle and wherein the positive elongated ear contact is in circuit with said switch assembly, said switch assembly comprises a contact carrier having contact means adapted to open and close a circuit between the positive elongated ear contact and the positive terminal of a battery, said switch assembly has a first contact in circuit with said positive elongated ear contact and a second contact in circuit with the positive terminal of a battery and wherein said contact means on said contact carrier is adapted to open and close the circuit between the elongated ear contact and the positive terminal of the battery, the negative elongated ear contact is in circuit with the negative terminal of a battery, said connecting head contacts comprise unshaped contacts mounted in the openings in said head.

2. A flashlight as set forth in claim 1 wherein said connecting head contacts and said elongated ear contacts are in contact with each other.

3. A flashlight as set forth in claim 2 wherein said connecting head contacts and said elongated ear contacts have openings therein.

4. A flashlight as set forth in claim 3, wherein said pivot means comprises pivot pins extending through the openings in said ears, said elongated ear contacts, said head contacts and said head and extend within said head.

5. A flashlight as set forth in claim 4, wherein a ratchet wheel is mounted on a pivot pin within said head and wherein a pawl in mounted within said head in contact with said ratchet wheel.

6. A flashlight as set forth in claim 5, wherein said ratchet wheel is a toothed ratchet wheel and is mounted on said pivot pin and is adopted to rotate with the pivotal movement of said head and wherein said pawl has a finger adapted to enter a tooth in said ratchet wheel to hold the head in a predetermined position.

7. A flashlight as set forth in claim 6 wherein a ratchet wheel is mounted on each pivot pin and wherein a pawl is mounted adjacent each ratchet wheel.

8. A flashlight as set forth in claim 7 wherein said ears are flat and said opposed sides are flat.

9. A flashlight comprising a handle and a head pivotally mounted on said handle, means for mounting a bulb within the head, said handle adapted to receive a battery, circuit means to adapt to create and electrical circuit between battery in said handle and a bulb whereby the bulb can be turned on and off, said handle having a pair of spaced upstanding ears, said head having opposed sides and being pivotally mounted between said upstanding ears, opening in said ears and in said opposed sides of said head, pivot means mounted in said openings in said head and said ears whereby said head can pivot relative to said upstanding ears and to said handle, said pivot means comprises pivot pins extending through the openings in said ears and said head extending within said head, a ratchet wheel is mounted on a pivot pin within said head and wherein a pawl is mounted within said head in contact with said ratchet wheel.

10. A flashlight as set forth in claim 9 wherein said ratchet wheel is a toothed ratchet wheel and is mounted on said pivot pin and is adopted to rotate with the pivotal movement of said head and wherein said pawl has a finger adapted to enter a tooth in said ratchet wheel to hold the head in a predetermined position.

11. A flashlight as set forth in claim 10 wherein a ratchet wheel is mounted on each pivot pin and wherein a pawl is mounted adjacent each ratchet wheel.

12. A flashlight as set forth in claim 11 wherein said ears are flat and wherein said opposed sides are flat.

* * * * *